US010743641B2

(12) United States Patent
Westrick

(10) Patent No.: US 10,743,641 B2
(45) Date of Patent: Aug. 18, 2020

(54) BACKPACK WITH MOVING FEATURES THAT CAN BE TRIGGERED

(71) Applicant: Jason Westrick, Wauseon, OH (US)

(72) Inventor: Jason Westrick, Wauseon, OH (US)

( * ) Notice: Subject to any disclaimer, the term of this patent is extended or adjusted under 35 U.S.C. 154(b) by 0 days.

(21) Appl. No.: 16/267,041

(22) Filed: Feb. 4, 2019

(65) Prior Publication Data

US 2019/0239625 A1 Aug. 8, 2019

Related U.S. Application Data

(60) Provisional application No. 62/626,176, filed on Feb. 5, 2018.

(51) Int. Cl.
*A45F 3/04* (2006.01)
*A45F 3/00* (2006.01)

(52) U.S. Cl.
CPC ..... *A45F 3/042* (2013.01); *A45F 2003/001* (2013.01)

(58) Field of Classification Search
CPC ..... A45F 3/042; A63J 19/00; A63J 19/006; Y10T 74/20323
USPC ..... 446/72–73, 26
See application file for complete search history.

(56) References Cited

U.S. PATENT DOCUMENTS 2,811,807 A * 11/1957 Swann ..... A45C 9/00 446/73
4,031,657 A * 6/1977 Crosman ..... A63H 13/06 446/333

FOREIGN PATENT DOCUMENTS

GB 2014-D72817 * 8/2012

* cited by examiner

*Primary Examiner* — Adam J Waggenspack
(74) *Attorney, Agent, or Firm* — Jacob M. Ward; Ward Law Office LLC

(57) ABSTRACT

A backpack has a character with external appendages on its rear portion that can be moved by a wearer of the backpack. The external appendages normally rest against the rear portion of the backpack and are configured to be selectively moved. Attachment points of the appendages are rotatably connected to motion devices, which in turn are connected by way of connecting lines to trigger features on a front portion of the backpack. When the trigger features are pulled, the appendages are raised into an active position by the motion devices, which in turn store energy from the pulling of the trigger features. By releasing the trigger features, the stored energy then causes the appendages to return to non-pulled resting positions.

15 Claims, 3 Drawing Sheets

BACKPACK WITH MOVING FEATURES THAT CAN BE TRIGGERED

CROSS-REFERENCE TO RELATED APPLICATIONS

This application claims the benefit of U.S. Provisional Application Ser. No. 62/626,176, filed on Feb. 5, 2018. The entire disclosure of the above application is hereby incorporated herein by reference.

FIELD

The present disclosure relates to backpacks and, more particularly, to backpacks with entertaining features for engagement by the wearer.

BACKGROUND

Backpacks are commonly worn by children. They are typically used for transporting books and supplies to and from school and associated venues.

Children and their parents often select their backpacks on the basis of a single criteria, namely, stylish design, colors, or patterns. Known backpacks may also have decorative or ornamental features like characters that are printed or sewn thereon. However, these known backpacks offer no interactive or entertaining features beyond these basic decorative or ornamental elements.

There is a continuing need for a backpack that is configured to both engage and entertain the child while wearing the backpack. Desirably, the backpack is more than just practical, and instead offers features that are fun and exciting for the child and others.

SUMMARY

In concordance with the instant disclosure, a backpack that is configured to both engage and entertain the child while wearing the backpack, and which is more than just practical, and instead offers features that are fun and exciting for the child and others, is surprisingly discovered.

In one embodiment, a backpack includes a main body, a character, at least one appendage, at least one connecting line, at least one trigger feature, and at least one motion device. The main body has a front portion, a rear portion, and a pair of shoulder straps. The shoulder straps are disposed on the front portion of the main body. The character is one of printed, formed, and attached to the rear portion of the main body. The at least one appendage is movably attached to the rear portion adjacent the character. The at least one connecting line is disposed through the main body and arranged from the front portion to the rear portion. The connecting line has a first end and a second end. The at least one trigger feature is connected to the first end of the connecting line and disposed adjacent the front portion of the main body. The at least one motion device is disposed on the rear portion of the main body and attached to the at least one appendage and the second end of the connecting line. The motion device is configured to selectively move the at least one appendage between a resting position and an active position upon an applying of a tension on the connecting line by a pulling of the trigger feature.

In another embodiment, a backpack includes a main body, a character, a right appendage, a left appendage, a right connecting line, a left connecting line, a right trigger feature, a left trigger feature, a right motion device, and a left motion device. The main body has a front portion, a rear portion, and a pair of shoulder straps. The shoulder straps are disposed on the front portion of the main body. The character is one of printed, formed, and attached to the rear portion of the main body. The right appendage is movably attached to the rear portion adjacent the character. The left appendage is movably attached to the rear portion adjacent the character. The right appendage is spaced apart from the left appendage with the character disposed therebetween. The right connecting line is disposed through the main body from the front portion to the rear portion. The right connecting line has a first end and a second end. The left connecting line is disposed through the main body from the front portion to the rear portion. The connecting line has a first end and a second end. The right trigger feature is connected to the first end of the right connecting line and disposed adjacent the front portion of the main body. The left trigger feature is connected to the first end of the left connecting line and disposed adjacent the front portion of the main body. The right motion device is disposed on the rear portion of the main body and attached to the right appendage and the second end of the right connecting line. The right motion device is configured to selectively move the right appendage between a resting position and an active position upon applying of a tension on the right connecting line by a pulling of the right trigger feature. The left motion device is disposed on the rear portion of the main body and attached to the left appendage and the second end of the left connecting line. The left motion device is configured to selectively move the left appendage between a resting position and an active position upon applying of a tension on the left connecting line by a pulling of the left trigger feature.

In a further embodiment, a method for operating a backpack includes the steps of providing the backpack, and disposing the backpack on a wearer such as child. The method further includes the step of pulling the at least one trigger feature, by the wearer, to cause the at least one appendage to move between the resting position and the active position by the applying of the tension on the connecting line.

In an exemplary embodiment, the backpack of the present disclosure offers animated features that can be triggered by a wearer of the backpack. This backpack design is comprised of six main items, including 1) external appendages, 2) spools, 3) attachment points, 4) resistance components, 5) connecting lines, and 6) trigger features.

The backpack of the present disclosure is illustrated generally herein with the external appendages. The external appendages are shown in a resting position against the backpack in a default mode. The external appendages are configured to be the portion of the backpack that offers an aesthetic look while being incorporated into the overall design appearance of the backpack. The external appendages are further configured to demonstrate movement. As one non-limiting example, the external appendages might be the arms of a robot character, which can be raised into the air, or the wings of a butterfly character that simulate a flapping motion. There may be other forms of motion that may be incorporated, such as vertical movement, twisting movements, or circular movements. The sizes and shapes of the appendages may vary based on the individual character designs that are being simulated. Also, it is possible to utilize only a single appendage or incorporate multiple appendages in the design. The most common use is two appendages. The materials used for making the appendages may vary and may include fabrics, plastics or some other suitable material.

The material used will most often have a predetermined degree of stiffness that will allow for a smooth and consistent range of motion.

The backpack is also illustrated herein with the external appendages in an active position, where a portion of either of the external appendages extends from the backpack.

The appendage includes an attachment point. The attachment point is configured to connect the appendage to the back or side surfaces of the backpack. The attachment point is further configured to facilitate fluid motion of the appendage from the resting position to the active position and vice versa. The attachment point may include a metal or plastic rod or other suitable material that can swivel or rotate. The attachment point may also include a fabric or other suitable material that is sewn through or otherwise adhered to the appendage and attaches to the back or side surface area of the backpack.

The resistance component is configured to trigger movement of the appendage into the active position and then revert the appendage back to its natural resting position. The resistance component can comprise various structures and devices, such as a rubber band. Other structures or other materials may be used such as, for example, a spring or a coil. In other embodiments, the resistance component can be accomplished by simply weighting the appendages allowing for basic gravitational forces to act upon it.

The backpack includes the connecting line. The connecting line is positioned within a connecting pathway or channel. The connecting line and the connecting pathway extend between and connect the appendages with the resistance component. The connecting line can be formed from materials such as string, rope, nylon cord, ribbon or other similar materials that would allow the connecting line to securely slide through the connecting pathway. In certain embodiments, the connecting pathway is positioned within the inner lining of the backpack such that the connecting pathway is concealed. This will create a more aesthetically pleasing design, and helps to ensure proper function. In other embodiments, the connecting pathway may have other positions within the backpack dependent on the positioning of the appendages for various designs. The backpack zipper also may have a non-traditional placement, in order to allow for the clear pathway or channel of the connecting line to the front straps.

The trigger feature is adhered to the end of the connecting line that runs through the front backpack straps. The trigger feature is formed from a knob, pull tab, pull ring, or handle-type device, and is configured such that the wearer can grab or pull down to activate the desired appendage motion. The trigger feature may also be activated by other means such as a button or switch being pressed or squeezed, in order to create the same effective motion of the desired appendage. When the trigger feature is released, the resistance component will cause the appendages to moving back to their original resting positions.

A user or wearer is also illustrated herein with the backpack. The user pulls down on the trigger features located on the front straps of the backpack, thereby causing the connecting line to be pulled through its designated pathway or channel. The connecting line, in turn, causes turning of the resistance component. The turning of the resistance component creates the lifting motion of the external appendages. By releasing the trigger features, the tension created by the resistance component forces the connecting line to coil in a reverse motion back to its neutral position, thus causing the attachment point to rotate back to its original place and the appendages to move back to their original resting position.

DETAILED DESCRIPTION

Figure 1:
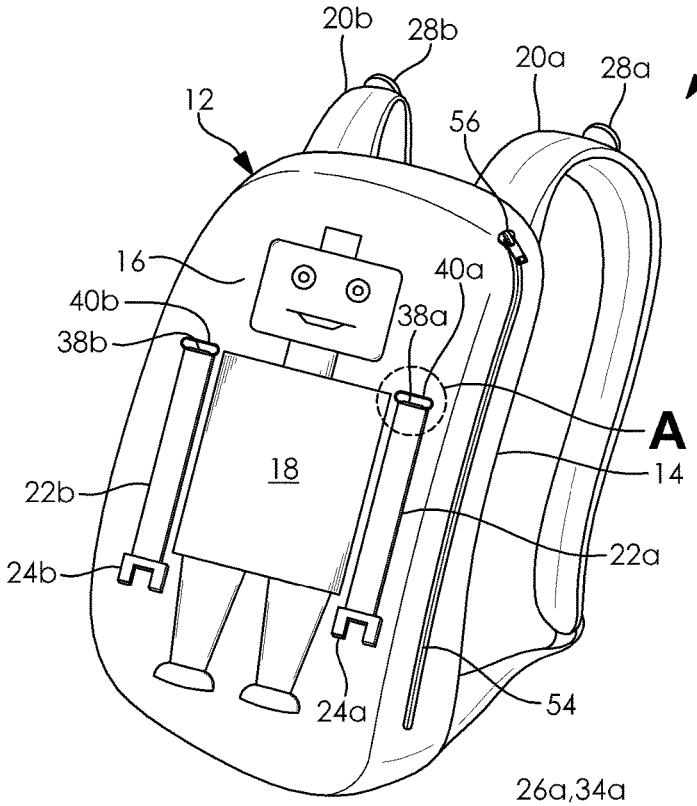
FIG. 1 is a rear perspective view of a backpack in accordance with the present disclosure, shown with both appendages in a resting position.

The following description is merely exemplary in nature and is not intended to limit the present disclosure, application, or uses. It should also be understood that throughout the drawings, corresponding reference numerals indicate like or corresponding parts and features. In respect of the methods disclosed, the order of the steps presented is exemplary in nature, and thus, is not necessary or critical unless otherwise disclosed.

FIGS. 1-10 illustrate a backpack 10 according to various embodiments of the present disclosure. The backpack 10 has a main body 12 with a front portion 14 and a rear portion 16. A character 18 is one of printed, disposed on, and otherwise formed from a separate material and attached to the rear portion 14 of the backpack 10. As non-limiting examples, the character 18 may be sewn to the rear portion 16 of the main body 12, or may be attached to the rear portion 16 of the main body 12 with an adhesive. Other suitable means for affixing the characters 18 to the main body 12 may also be employed within the scope of the present disclosure.

Although the character 18 generally shown in FIGS. 1, 3, and 8-10 is a robot, it should be appreciated that any other type of the character 18 may also be used on the backpack 10 and is contemplated. Non-limiting examples of characters 18 that may be disposed on the rear portion 16 of the backpack 10 may include super heroes, animals, people, nature figures, sports figures, mechanical items, caricatures, and landscapes. A skilled artisan may select other suitable types of the characters 18, as desired.

Figure 8:
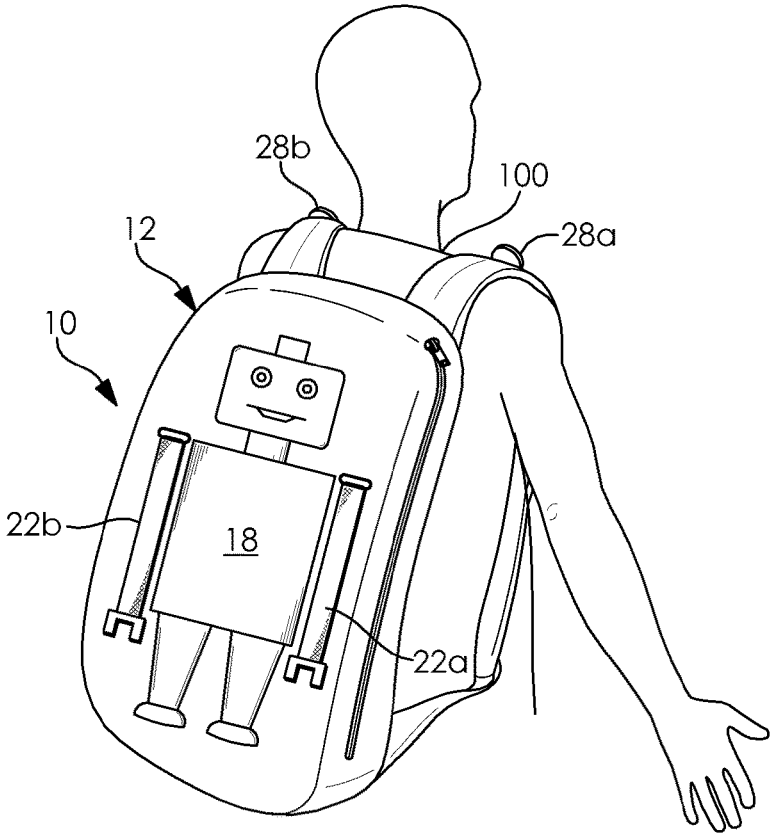
FIG. 8 is a rear perspective view of the backpack shown in FIG. 1, and further showing the backpack being worn by a wearer with neither of the trigger features being pulled.
Figure 9:
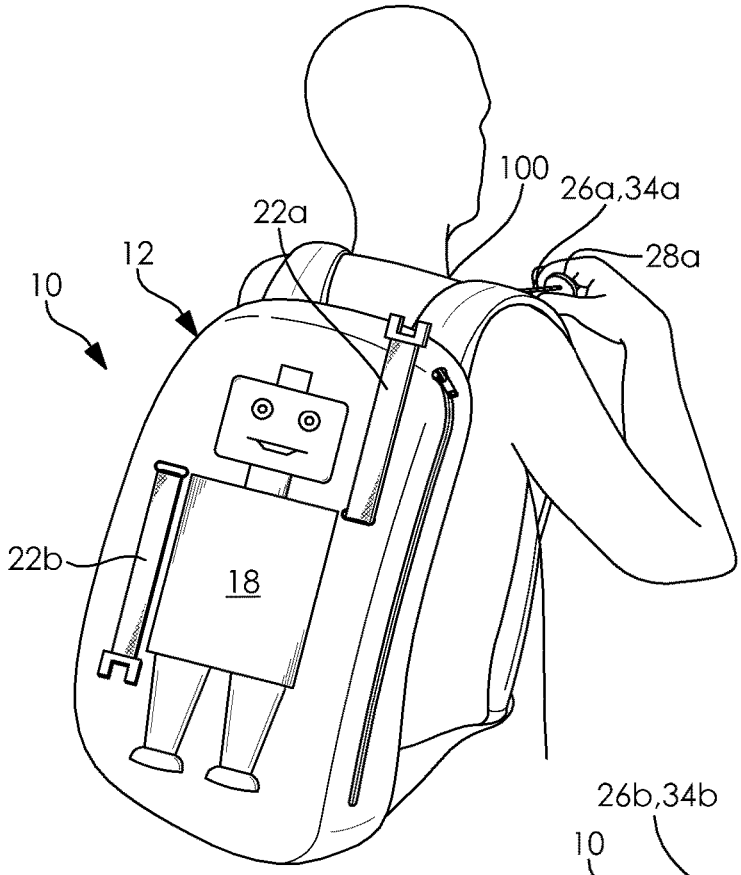
FIG. 9 is a rear perspective view of the backpack shown in FIG. 1, and further showing the wearer pulling a single one of the trigger features to place an associated one of the appendages in the active position, and not pulling the other of the trigger features so that an associated one of the appendages is in the resting position.
Figure 10:
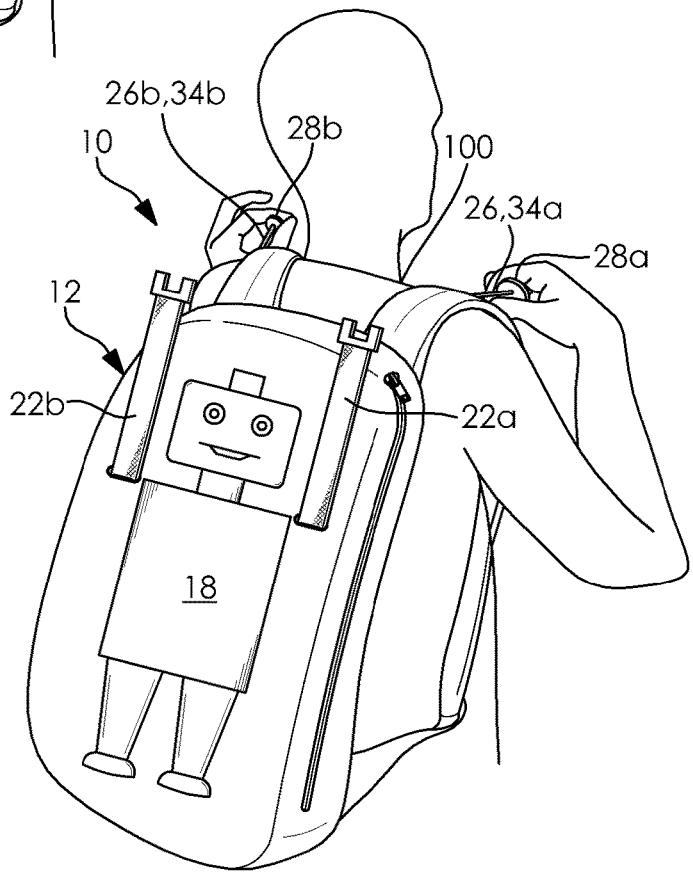
FIG. 10 is a rear perspective view of the backpack shown in FIG. 1, and further showing the wearer puling on both of the trigger features simultaneously in order to place both of the associated appendages in the active position.

With reference to further descriptions herein, it should be understood that reference numbers in FIGS. 1-10 having a letter "a" at the end of the number refer to those items that are located from a perspective of a right side of a wearer 100 of the backpack 10, such as shown in FIGS. 8-10. Conversely, reference numbers having a letter "b" at the end of the number refer to those items that are located from a perspective of a left side of the wearer 100 of the backpack 10. It should also be understood that details and features which apply to the left side, as disclosed herein below, also apply to the right side unless otherwise disclosed, and vice-versa.

Figure 3:
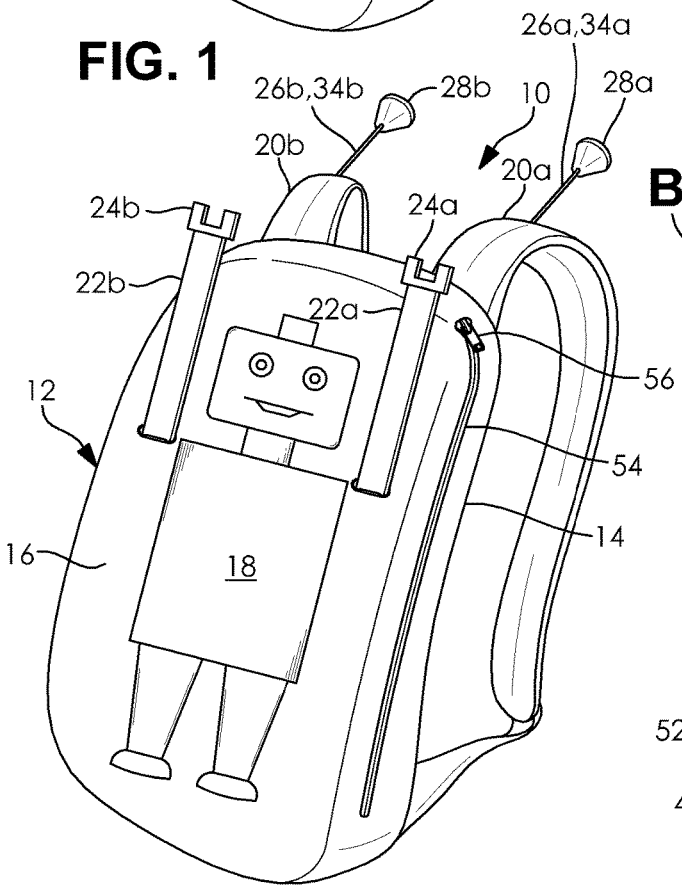
FIG. 3 is a rear perspective view of the backpack shown in FIG. 1, and further showing both appendages in an active position.

The backpack 10 of the present disclosure is configured to be worn by a wearer 100, such as a child, as shown in FIGS. 8-10. In particular, the backpack 10 has pair of shoulder straps 20*a*, 20*b*. The shoulder straps 20*a*, 20*b* are disposed on the front portion 14 of the main body 12, for example, and may include a right shoulder strap 20*a* and a left shoulder strap 20*b*, as shown in FIGS. 1 and 3. In operation, the shoulder straps 20*a*, 20*b* are disposed over the shoulders of the wearer 100, for example, as shown in FIGS. 8-10, for the transporting of supplies to and from schools and associated venues.

In reference to FIGS. 1, 3, 6, and 8-10, the backpack 10 of the present disclosure includes at least one appendage 22*a*, 22*b*. The at least one appendage 22*a*, 22*b* may be representative of arms or legs or the character 18, for example. Similarly, the appendages 22, 22 may also be provided with end features 24*a*, 24*b* to approximate hands or feet of the character 18. For example, the at least one appendage 22*a*, 22*b* may include a right appendage 22*a* associated with the right shoulder strap 20*a*, which is naturally at the left side of the character 18, and a left appendage 22*b* associated with the left shoulder strap 20*b*, which is naturally at the right side of the character 18.

Advantageously, the at least one appendage 22*a*, 22*b* of the present disclosure is movably attached to the rear portion 16 of the main body 12 adjacent to the character 18. In particular, the at least one appendage 22*a*, 22*b* is selectively movable between a resting position and an active position, and vice-versa, as described further herein. As used herein, the term "resting position" is defined to mean a major portion of the at least one appendage 22*a*, 22*b* is disposed closely adjacent to or abutting the rear portion 16 of the backpack 10. The term "active position," as used herein, is defined to mean the major portion of the at least one appendage 22*a*, 22*b* is spaced apart from and extended at least one of outwardly and upwardly from the rear portion 16 of the backpack 10. The term "active position" is also defined to include any position of the at least one appendage 22*a*, 22*b* other than the rested position, including partly extended and fully extend positions for the at least one appendage 22*a*, 22*b*. There may also be other forms of motion that may be incorporated into the active position, such as vertical movement, twisting movement, or circular movement, as non-limiting examples.

It should be appreciated that this movement of the at least one appendage 22*a*, 22*b* provides considerable entertainment for a child wearer 100 and friends of the same. Although not shown, in another example the at least one appendage 22*a*, 22*b* may be wings of a butterfly character that may be raised into the air with a flapping motion. A skilled artisan may select other suitable types of the at least one appendage 22*a*, 22*b*, as desired.

As shown in FIG. 1, the at least one appendage 22*a*, 22*b* of the character 18 may be oriented downwardly by default in the resting position against the rear portion 16 of the backpack 10. The at least one appendage 22*a*, 22*b* is therefore configured to be a part of aesthetic of the backpack 10 and may be incorporated into the overall design appearance of the backpack 10, regardless of the functionality of the at least one appendage 22*a*, 22*b* as described herein.

The at least one appendage 22*a*, 22*b* is further configured to be selectively moved to the active position, as shown in FIG. 3. The sizes and shapes of the at least one appendage 22*a*, 22*b* can vary based on the individual designs of the character 18 being simulated. Also, it is possible to utilize only a single appendage 22*a*, 22*b* or incorporate more than two appendages 22*a*, 22*b* in the design.

Suitable materials for the at least one appendage 22*a*, 22*b* may include fabrics and plastics, as non-limiting examples. Desirably, the selected material will contain a sufficient degree of stiffness or rigidity to allow for a smooth and consistent range of motion of the at least one appendage 22*a*, 22*b*, without a significant bending of the at least one appendage 22*a*, 22*b*, as it moves between the rested position and the active position. The at least one appendage 22*a*, 22*b* may also be provided with support rods disposed within the at least one appendage 22*a*, 22*b* for this purpose. One of ordinary skill in the art may select other suitable materials and constructions for the at least one appendage 22*a*, 22*b* within the scope of the present disclosure.

As shown in FIGS. 1-10, the backpack 10 of the present disclosure further includes at least one connecting line 26*a*, 26*b*, at least one trigger feature 28*a*, 28*b*, at least one motion device 30*a*, 30*b*, and at least one channel 32*a*, 32*b*. The at last one connecting line 26*a*, 26*b* may include a right connecting line 26*a* and a left connecting line 26*b*, for example. The at least one trigger feature 28*a*, 28*b* may include a right trigger feature 28*a* and a left trigger feature 28*b*, for example. The at least one motion device 30*a*, 30*b* may include a right motion device 30*a* and a left motion device 30*b*, for example. The at least one channel 32*a*, 32*b* may include a right channel 32*a* and a left channel 32*b*, for example. In this arrangement, it should be appreciated that the right appendage 22*a* and the left appendage 22*b* are configured to be individually and selectively moved between the resting position and the active position by the pulling of an associated one of the right trigger feature 28*a* and the left trigger feature 28*b*. Thus, the wearer 100 can choose to raise just one or both of the right and left appendages 22*a*, 22*b*, as desired.

The at least one connecting line 26*a*, 26*b* may be a rope, string, cord, ribbon, or chain, as non-limiting examples. The at least one connecting line 26*a*, 26*b* is disposed through the at least one channel 32*a*, 32*b*, which is likewise disposed through the main body 12, and particularly through one of the shoulder straps 20*a*, 20*b* and arranged from the front portion 14 to the rear portion 16. The at least one channel 32*a*, 32*b* may be formed by a fold in the material or fabric of the main body 12, for example. In another example, the channel 32*a*, 32*b* may be formed from a plastic tube disposed within the main body 12. Other suitable means for forming the chancel 32*a*, 32*b* may also be employed.

The at least one connecting line 26*a*, 26*b* furthermore has a first end 34*a*, 34*b* and a second end 36*a*, 36*b*. The first end 34*a*, 34*b* is connected to the at least one trigger feature 28*a*, 28*b*, and the second end 36*a*, 36*b* is connected to the at least one motion device 30*a*, 30*b* as detailed further hereinbelow.

The at least one trigger feature 28*a*, 28*b* may be provided as a knob, pull tab, pull ring, or handle, as non-limiting examples. In particular, the at least one trigger feature 28*a*, 28*b* permits the wearer 100 to manually grab or pull down to create a tension in the connecting line 26*a*, 26*b*. In turn, this tension is used to activate the desired motion of the corresponding appendage 22*a*, 22*b* via the at least one motion device 30*a*, 30*b*. The trigger feature 28*a*, 28*b* may also be activated by other means, such as a button or switch being pressed or squeezed, in order to create the same effective motion of the associated appendage 22*a*, 22*b*, as desired.

Figure 2:
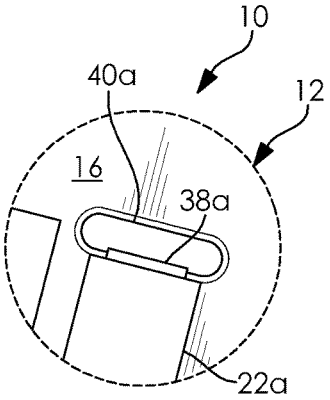
FIG. 2 is an enlarged partial perspective view of the backpack taken at call-out A in FIG. 1, and further showing an attachment point for one of the appendages.

With reference to FIGS. 1-2, it should be understood that at least one appendage 22*a*, 22*b* may be fixedly connected to the at least one motion device 30*a*, 30*b* at an attachment point 38*a*, 38*b*. The attachment point 38*a*, 38*b* may be disposed through an aperture 40*a*, 40*b*, which is formed in the rear portion 16 of the main body 12, for example, in order to connect the appendage 22*a*, 22*b* on the outside with the motion device 30*a*, 30*b* on the inside of the main body 12. The attachment point 38*a*, 38*b* may be centrally disposed on the spool 42*a*, 42*b* or offset to one side of the spool 42*a*, 42*b*, as desired.

The at least one motion device 30*a*, 30*b* is disposed on the rear portion 16 of the main body 12. The motion device 30*a*, 30*b* is attached to the at least one appendage 22*a*, 22*b* at the attachment point 28*a*, 28*b*, and also to the second end 36*a*, 36*b* of the connecting line 26*a*, 26*b* as described hereinabove. The motion device 30*a*, 30*b* is configured to selectively move the at least one appendage 22*a*, 22*b* between the resting position (shown in FIG. 1) and the active position (shown in FIG. 3) upon the applying of the tension on the connecting line 26*a*, 26*b* by the pulling of the trigger feature 28*a*, 28*b*.

Figure 4:
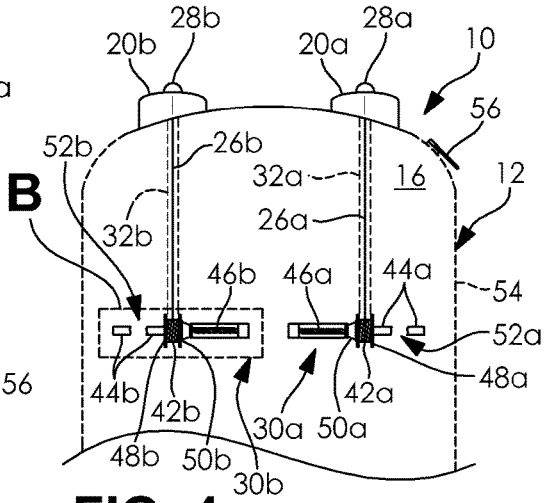
FIG. 4 is a partial rear elevational view of the backpack shown in FIG. 1, and further showing connecting lines, spools, and resistance components therein.
Figure 5:
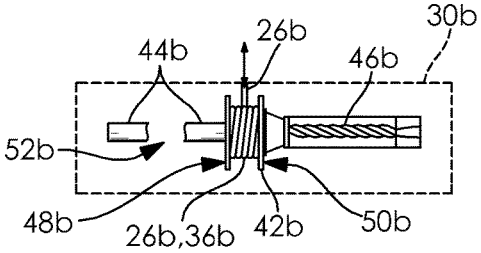
FIG. 5 is an enlarged partial rear elevational view taken a call-out B in FIG. 4, and further showing a right connecting line with an associated spool, resistance cover, fixed rod, and resistance component.
Figure 6:
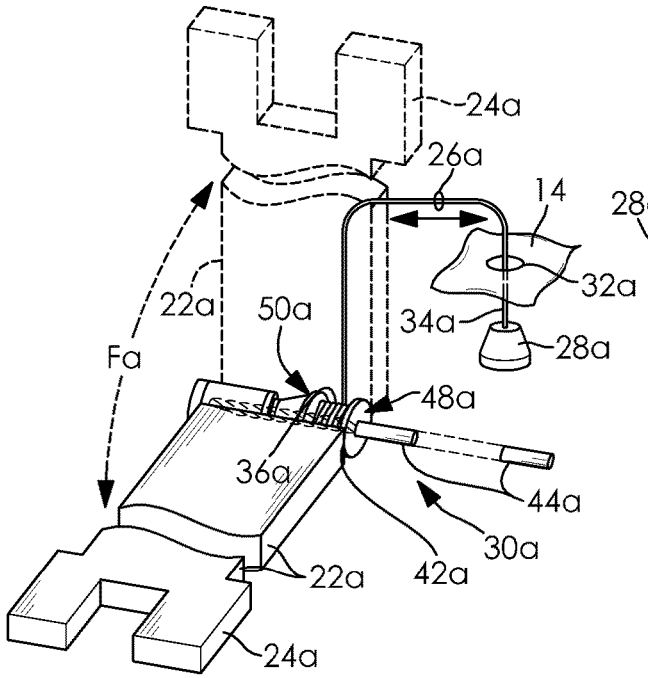
FIG. 6 is an enlarged rear perspective view of an internal mechanism of the appendage of the backpack shown in FIG. 1, with broken lines depicting the appendage in a fully active position.
Figure 7:
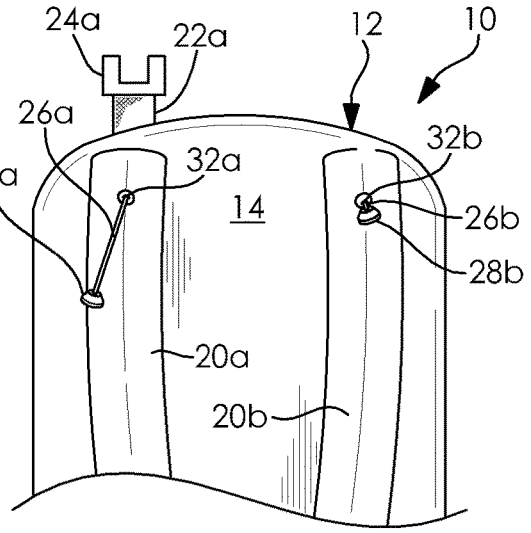
FIG. 7 is a partial front elevational view of a front portion of the backpack shown in FIG. 1, and further showing one trigger feature pulled with a corresponding appendage being in the active position and the other trigger feature not pulled with a corresponding appendage being in the resting position.

In particular embodiments, as shown in FIGS. 4-6, the motion device 30*a*, 30*b* includes a spool 42*a*, 42*b*, a connecting rod 44*a*, 44*b*, and a resistance member 46*a*, 46*b*. The spool 42*a*, 42*b* has a first side 48*a*, 48*b* and a second side 50*a*, 50*b*. The connecting rod 44*a*, 44*b* is connected to the first side 48*a*, 48*b* of the spool 42*a*, 42*b*. The connecting rod 44*a*, 44*b* is also connected to the rear portion 16 of the main body 12. For example, the connecting rod 44*a*, 44*b* may be disposed or "threaded" through a connecting area 52*a*, 52*b* of the rear portion 16, as shown in FIGS. 4 and 5. In this arrangement, the connecting rod 44*a*, 44*b* militates against an undesired removal of the spool 42*a*, 42*b* from the rear portion 16 where the connecting line 26*a*, 26*b* is pulled, in operation. The connecting rod 44*a*, 44*b* may be formed from metal, plastic, wood, or any other suitably rigid material. Other suitable means for affixing the connecting rod 44*a*, 44*b* to the rear portion 16 of the main body 12 may also be employed, as desired.

As further shown in FIGS. 4-6, the second end 36*a*, 36*b* of the connecting line 26*a*, 26*b* may be coiled around the spool 42*a*, 42*b*. The spool 42*a*, 42*b* is also configured to be rotatable in a first direction of rotation by the application of the tension on the connecting line 26*a*, 26*b* by the pulling of the trigger feature 28*a*, 28*b*. For example, the spool 42*a*, 42*b* may be rotatably attached to the connecting rod 44*a*, 44*b*, or affixed to the connecting rod 44*a*, 44*b* with the spool 42*a*, 42*b* and the connecting rod 44*a*, 44*b* together being rotatable. Suitable bearings and other means for facilitating the rotation of the spool 42*a*, 42*b* in either configuration may also be employed within the scope of the present disclosure.

With continued reference to FIGS. 4-6, the resistance member 46*a*, 46*b* may be attached to the second side 50*a*, 50*b* of the spool 42*a*, 42*b*. The resistance member 46*a*, 46*b* may also be attached to the rear portion 16 of the main body 12. The resistance member 46*a*, 46*b* is configured to supply a nominal resistance to the pulling of the connecting line 26*a*, 26*b* by the wearer 100. In particular embodiments, the resistance member 46*a*, 46*b* may be one a rubber band, a coiled spring, and a weight. Where the coiled spring is employed, the spring may be a flat coiled spring, for example. Where the weight is employed, it should be appreciated that the weight may take advantage of basic use of gravitational forces to cause the nominal resistance to the pulling. However, a skilled artisan may select other suitable types of the resistance member 46*a*, 46*b*, as desired.

Additionally, it should be appreciated that the resistance member 46*a*, 46*b* is configured to store rotational energy provide by the rotation of the spool 42*a*, 42*b* in the first direction of rotation (e.g., clockwise), and subsequently and selectively release rotational energy to cause a rotation of the spool 42*a*, 42*b* in a second direction of rotation (e.g., counter-clockwise), where the tensions is not applied on the connecting line by the pulling of the trigger feature. It should likewise be understood that the second direction of rotation is opposite the first direction of rotation in this embodiment.

Although the manually operated motion device 30*a*, 30*b* having the spool 42*a*, 42*b*, the connecting rod 44*a*, 44*b*, and the resistance member 46*a*, 46*b* are described specifically hereinabove and shown in FIGS. 4-6, one of ordinary skill in the art may also employ other types of moving devices 30*a*, 30*b* including automated, motorized, or battery-operated moving devices 30*a*, 30*b*, as desired.

With renewed reference to FIGS. 1-3 and 6, and as also disclosed hereinabove, the at least one appendage 22*a*, 22*b* may be attached to the rotatable spool 42*a*, 42*b* at the attachment point 38*a*, 38*b*. Thus, the rotation of the spool 42*a*, 42*b* in the first direction of rotation likewise causes the at least one appendage 22*a*, 22*b* to move from the resting position to the active position in one mode of operation, and the rotation of the spool 42*a*, 42*b* in the second direction of rotation causes the at least one appendage 22*a*, 22*b* to move from the active position to the resting position, in another mode of operation. Due to the attachment point 38*a*, 38*b*, an inner surface of the at least one appendage 22*a*, 22*b* may be disposed adjacent the rear portion 16 of the main body 12 where in the resting position, and the inner surface of the at least one appendage 22*a*, 22*b* may be spaced apart from the rear portion 16 of the main body 12 where in the active position.

In particular, the at least one attachment point 38*a*, 38*b* is configured to rotationally connect the appendage 22*a*, 22*b* to the rear portion 16 of the backpack 10, while being further configured to facilitate fluid motion of the appendage 22*a*, 22*b* from the resting position to the active position, and vice-versa. The attachment point 38*a*, 38*b*, for example, as shown in FIG. 2, may include a metal or plastic rod or other suitable material that may be capable of swiveling or rotating the appendage 22*a*, 22*b*. Furthermore, the attachment point 38*a*, 38*b* may be covered with fabric or other material that is sewn through or otherwise adhered to the appendage 22*a*, 22*b*, thereby attaching to the rear portion 16 of the backpack 10 adjacent to the character 12.

Referring to FIGS. 1, 3-4, and 8-10, the backpack 10 of the present disclosure further has an opening 54 that is formed in the main body 12. The opening 54 is configured to receive items such as books and supplies therethrough for storage in the interior of the main body 12. In particular, the opening 54 is formed through only one side of the main body 12, so as to not interfere with the channel 32*a*, 32*b* through which the connecting line 26*a*, 26*b* is slidably and operably disposed.

For example, the opening 54 may be a slit formed between and separating the front portion 14 and the rear portion 16 of the main body 12, but which does not extend substantially into an upper portion or shoulder area of the main body 12. In this arrangement, the channel 32*a*, 32*b* is spaced apart from the opening 54 in the main body 12 so that the connecting line 26*a*, 26*b* is not disposed through the opening 54, but instead is only disposed through the channel 32*a*, 32*b*.

The opening 54 may also be configured to be selectively opened and closed with a fastener 56. In a most particular embodiment, the fastener 56 is a zipper. One of ordinary skill in the art may also select other suitable types of fasteners 56 within the scope of the disclosure.

Due to the disclosed positioning of the channels 32*a*, 32*b* relative to the side opening 54, it should be appreciated that the zipper 56 of the instant disclosure is also not disposed or movable across the top of the backpack 10, which is different from the construction of conventional backpacks. Instead, the zipper 56 of the backpack 10 is disposed on only one side of the backpack 10, for example, as shown in FIGS. 1 and 3. The zipper 56 is not disposed across a top or shoulder of the backpack 10, which permits for the location of the channels 32*a*, 32*b* over the shoulders of the wearer 100, in operation, as shown in FIGS. 8-10.

FIGS. 8-10 also illustrate various positions associated with raising and lowering the appendages 22*a*, 22*b*. FIG. 8 shows the appendages 22*a*, 22*b* in the resting position, with neither of the trigger features 28*a*, 28*b* being pulled by the wearer 100. FIG. 9 shows the right trigger feature 28*a* being pulled, which in turn pulls on the right connecting line 26*a*, which in turn raises the right appendage 22*a* into the active position. FIG. 10 shows that both of the right and left trigger features 28*a*, 28*b* are being pulled, resulting in the right and left appendages 22*a*, 22*b* also being raised to the active position.

As shown in FIG. 6, at least a portion of the motion device 30*a*, 30*b* may be covered with an additional fabric or material. For example, the additional fabric or material may be placed over at least a portion of an inboard end of the motion device 30*a*, 30*b*, so as to protect or encase the associated resistance member 46*a*, 46*b*. Other suitable means for protecting the motion device 30*a*, 30*b* and ensuring operability of the same over time may also be employed.

FIG. 6 also details the mechanics of both the application and the non-application of an external force Fa for the movements of the appendage 22*a*. Although shown in FIG. 6 and discussed with respect to the right appendage 22*a*, it should be appreciated that the application and non-application of the external force Fa also applies to the left appendage 22*b*, in operation. Where the external force Fa is not applied to the appendage 22*a*, by way of the connecting line 26*a* being affixed and fully coiled around the spool 42*a*, then the appendage 22*a* rests in its natural resting position. On the other hand, when the wearer 100 pulls on the right trigger feature 28*a*, then the appendage 22*a* is raised by way of the tension applied to the connecting line 26*a* as it is pulled. This likewise stores energy in the resistance member 44*a*, which is twisted or coiled by the rotation of the spool 42*a*, since the connecting line 26*a* is being uncoiled from around the spool 42*a*. Consequently, when the trigger feature 28*a* is released and allowed to return to its non-extended position, then the energy stored in the resistance member 44*a* is released and causes an opposite rotation of the spool 42*a* to recoil the connecting line 20*a* around the spool 42*a*.

In operation, and according to the method of operating the backpack 10 according to the present disclosure, the method may include the steps of providing the backpack 10 and disposing the backpack 10 on the wearer 100, for example, across the shoulders of the wearer 100 as shown in FIG. 8-10. Once the backpack 10 is on the wearer 100, the method further includes the step of pulling the at least one trigger feature 28*a*, 28*b*, by the wearer 100, to cause the at least one appendage 22*a*, 22*b* to move between the resting position and the active position by the applying of the tension on the connecting line 26*a*, 26*b* as disclosed hereinabove.

Advantageously, the backpack 10 of the present disclosure is configured to engage and entertain the wearer 100 while wearing the backpack 10. The backpack 10 is more than just practical and instead offers features that are fun and exciting to the wearer 100 and friends of the same.

Other variations and embodiments of the invention are contemplated. Those skilled in the art will readily appreciate such variations upon carefully reviewing the above disclosure. Therefore, the present invention is not to be limited by the above description, but is to be determined in the scope of the claims which follow.

What is claimed is:

1. A backpack, comprising:

a main body with a front portion, a rear portion, and a pair of shoulder straps, the shoulder straps disposed on the front portion of the main body;

a character one of printed, formed, and attached to the rear portion of the main body;

at least one appendage movably attached to the rear portion adjacent the character;

at least one connecting line disposed through the main body from the front portion to the rear portion, the connecting line having a first end and a second end;

at least one trigger feature connected to the first end of the connecting line and disposed adjacent the front portion of the main body; and at least one motion device disposed on the rear portion of the main body and attached to the at least one appendage and the second end of the connecting line, the motion device configured to selectively move the at least one appendage between a natural resting position and an active position upon an applying of a tension on the connecting line by a pulling of the trigger feature, wherein the at least one motion device includes a spool with a first side and a second side, a connecting rod, and a resistance member, the connecting rod attached to the first side of the spool, and the connecting rod also connected to the rear portion of the main body, the second end of the connecting line coiled around the spool, and the spool rotatable in a first direction of rotation by the application of the tension on the connecting line by the pulling of the trigger feature, the resistance member attached to the second side of the spool and attached to the rear portion of the main body, and the resistance member configured to store rotational energy provide by a rotation of the spool in the first direction of rotation and release rotational energy to cause a rotation of the spool in a second direction of rotation when the tension is not applied on the connecting line by the pulling of the trigger feature, and the second direction of rotation is opposite the first direction of rotation, and wherein the at least one appendage is disposed through at least one aperture formed in the rear portion of the main body and movably attached to both the rear portion of the main body adjacent to the at least one aperture and to the spool at an attachment point to connect the at least one appendage on an outside of the main body with the at least one motion device on an inside of the main body.

2. The backpack of claim 1, wherein the connecting rod is disposed through a connecting area of the rear portion of the main body.

3. The backpack of claim 1, wherein the resistance member is one a rubber band, a coiled spring, and a weight.

4. The backpack of claim 1, wherein the rotation of the spool in the first direction of rotation causes the at least one appendage to move from the natural resting position to the active position, and the rotation of the spool in the second direction of rotation causes the at least one appendage to move from the active position to the natural resting position.

5. The backpack of claim 4, wherein the at least one appendage is disposed adjacent the rear portion of the main body where when in the natural resting position, and the at least one appendage is spaced apart from the rear portion of the main body when in the active position.

6. The backpack of claim 1, wherein the main body has a channel formed therein, the channel disposed through one of the pair of shoulder straps, the front portion of the main body, and the rear portion of the main body.

7. The backpack of claim 6, wherein the at least one connecting line is disposed through the channel.

8. The backpack of claim 7, wherein the main body further has an opening formed through one side of the main body between the front portion and the rear portion of the main body, and a zipper for selectively opening and closing the opening.

9. The backpack of claim 8, wherein the channel is spaced apart from the opening in the main body.

10. The backpack of claim 1, wherein the at least one appendage includes a right appendage and a left appendage, the right appendage spaced apart from the left appendage with the character disposed therebetween, the at least one connecting line includes a right connecting line and a left connecting line, the at least one trigger feature includes a right trigger feature and a left trigger feature, and the at least one motion device includes a right motion device and a left motion device.

11. The backpack of claim 10, wherein the right trigger feature is connected to the right motion device via the right connecting line, and the left trigger feature is connected to the left motion device via the left connecting line.

12. The backpack of claim 11, wherein the right appendage and the left appendage are configured to be individually and selectively movable between the natural resting position and the active position by the pulling of an associated one of the right trigger feature and the left trigger feature.

13. A method of operating a backpack, the method comprising the steps of:

providing the backpack including a main body with a front portion, a rear portion, and a pair of shoulder straps, the shoulder straps disposed on the front portion of the main body, a character one of printed, formed, and attached to the rear portion of the main body, at least one appendage movably attached to the rear portion adjacent the character, at least one connecting line disposed through the main body from the front portion to the rear portion, the connecting line having a first end and a second end, at least one trigger feature connected to the first end of the connecting line and disposed adjacent the front portion of the main body, and at least one motion device disposed on the rear portion of the main body and attached to the at least one appendage and the second end of the connecting line, the motion device configured to selectively move the at least one appendage between a natural resting position and an active position upon an applying of a tension on the connecting line by a pulling of the trigger feature, wherein the at least one motion device includes a spool with a first side and a second side, a connecting rod, and a resistance member, the connecting rod attached to the first side of the spool, and the connecting rod also connected to the rear portion of the main body, the second end of the connecting line coiled around the spool, and the spool rotatable in a first direction of rotation by the application of the tension on the connecting line by the pulling of the trigger feature, the resistance member attached to the second side of the spool and attached to the rear portion of the main body, and the resistance member configured to store rotational energy provide by a rotation of the spool in the first direction of rotation and release rotational energy to cause a rotation of the spool in a second direction of rotation when the tension is not applied on the connecting line by the pulling of the trigger feature, and the second direction of rotation is opposite the first direction of rotation, and wherein the at least one appendage is disposed through at least one aperture formed in the rear portion of the main body and movably attached to both the rear portion of the main body adjacent to the at least one aperture and to the spool at an attachment point to connect the at least one appendage on an outside of the main body with the at least one motion device on an inside of the main body;

disposing the backpack on a wearer; and pulling the at least one trigger feature, by the wearer, to cause the at least one appendage to move between the natural resting position and the active position by the applying of the tension on the connecting line.

14. The backpack of claim 1, whereby the at least one appendage is in the natural resting position without any tension when an external force is not applied to the at least one appendage by way of the at least one connecting line.

15. The method of claim 13, whereby the at least one appendage is in the natural resting position without any tension when an external force is not applied to the at least one appendage by way of the at least one connecting line.

* * * * *